US007164436B2

(12) United States Patent
Kumagai et al.

(10) Patent No.: US 7,164,436 B2
(45) Date of Patent: Jan. 16, 2007

(54) LIQUID EJECTION APPARATUS

(75) Inventors: Toshio Kumagai, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 275 days.

(21) Appl. No.: 10/841,832

(22) Filed: May 10, 2004

(65) Prior Publication Data

US 2005/0012792 A1 Jan. 20, 2005

(30) Foreign Application Priority Data

May 9, 2003 (JP) ..... P. 2003-132345

(51) Int. Cl.
*B41J 2/175* (2006.01)

(52) U.S. Cl. ..... 348/85

(58) Field of Classification Search ..... 347/7, 347/30, 81, 85, 86, 87; 417/182.5, 413.1
See application file for complete search history.

(56) References Cited

U.S. PATENT DOCUMENTS 4,432,005 A * 2/1984 Duffield et al. ..... 347/86
4,558,326 A * 12/1985 Kimura et al. ..... 347/30
6,113,228 A * 9/2000 Pawlowski et al. ..... 347/81
6,290,343 B1 * 9/2001 Lewis et al. ..... 347/85
6,811,249 B1 * 11/2004 DeVries et al. ..... 347/85
6,945,641 B1 * 9/2005 Sakai et al. ..... 347/86

FOREIGN PATENT DOCUMENTS

JP 2001-199079 * 7/2001
JP 2002-200749 A 7/2002

* cited by examiner

*Primary Examiner*—Anh T. N. Vo
(74) *Attorney, Agent, or Firm*—Sughrue Mion, PLLC

(57) ABSTRACT

A liquid ejection apparatus includes liquid cartridges, each of which includes a liquid container and a pressure chamber, the liquid container having a flexible portion and storing liquid therein, and the pressure chamber applying pressure to the flexible portion of the liquid container; a liquid ejection head, which ejects the liquid; liquid flow paths, which communicate the liquid containers with the liquid ejection head; and an air supply member, which supplies pressurized air to the pressure chambers for compressing the flexible portions so as to supply the liquid from the liquid containers to the liquid flow paths. The air supply member includes: a distribution member, which has an air intake portion for introducing the pressurized air, and air outlet portions for distributing the pressurized air to the liquid cartridges, and branch flow paths, which respectively communicate the air outlet portions with the pressure chambers of the liquid cartridges.

14 Claims, 9 Drawing Sheets

LIQUID EJECTION APPARATUS

BACKGROUND OF THE INVENTION

The present invention relates to a liquid ejection apparatus.

An ink jet recording apparatus, which is one type of a liquid ejection apparatus, records data on a medium, such as paper, positioned opposite a recording head which is mounted on a reciprocating carriage and which ejects, onto the medium, ink supplied from an ink storage cartridge.

One type of ink jet recording apparatus is a so-called off-carriage type, which is so designed that, to reduce the load imposed on the carriage, or to reduce the size or the thickness of the apparatus, the ink cartridge is not mounted on the carriage. This type of ink cartridge generally includes an ink pack for storing ink and a case wherein the ink pack is mounted. To supply ink from the ink cartridge to an ink tube, air under pressure is supplied by an air pressure pump to a gap between the case and the ink pack, so that ink, impelled by the pressurized air filling the gap, is forced out of the ink pack and into the ink tube (e.g., see JP-A-2002-200749).

For the off-carriage type ink jet recording apparatus, the number of air tubes, which communicates the air pump with the ink cartridges and through which pressurized air is supplied, corresponds to the number of ink cartridges employed. The number of ink tubes, which communicates the ink cartridges with the recording head, corresponds to the number of ink cartridges employed. Thus, for an assembly operation performed to connect the tubes, a labor intensive effort is required.

SUMMARY OF THE INVENTION

It is therefore an object of the present invention to provide a liquid ejection apparatus for which, when an assembly operation is performed, a reduction can be realized in the required labor effort.

In order to achieve the above object, according to the present invention, there is provided a liquid ejection apparatus, comprising:

- a plurality of liquid cartridges, each of which includes a liquid container and a pressure chamber, the liquid container having a flexible portion and storing liquid therein, and the pressure chamber applying pressure to the flexible portion of the liquid container;
- a liquid ejection head, which ejects the liquid;
- a plurality of liquid flow paths, which communicate the liquid containers with the liquid ejection head; and
- an air supply member, which supplies pressurized air to the pressure chambers for compressing the flexible portions so as to supply the liquid from the liquid containers to the liquid flow paths, wherein the air supply member includes:

- a distribution member, which has an air intake portion for introducing the pressurized air, and a plurality of air outlet portions for distributing the pressurized air to the liquid cartridges; and
- a plurality of branch flow paths, which respectively communicate the air outlet portions with the pressure chambers of the liquid cartridges.

According to this invention, the pressurized air is supplied to the distribution member. The pressurized air is introduced to the branch flow paths connected to the distribution member. The air entering along the branch flow paths is distributed into gap defined between the liquid container and the pressure chamber of each of the liquid cartridges respectively communicating with the branch flow paths. According to this configuration, during the assembly process, a plurality of tubes constituting air flow paths need not be drawn inside the liquid ejection apparatus in order to connect an air pump to the liquid cartridges. Therefore, the assembly of the liquid ejection apparatus is simplified. Further, since portions of the air flow paths converge at the distribution member, the space occupied by the air flow paths in the liquid ejection apparatus can be reduced.

In the liquid ejection apparatus, the lengths of the branch flow paths are uniform.

With this configuration, since the lengths of the branch flow paths are uniform, the manufacture of the branch flow paths can be simplified.

In the liquid ejection apparatus, the distribution member includes a distribution flow path which communicate the air intake portion with the air outlet portion. The distribution flow path includes an air groove, formed in a flow path formation member, and a first flexible member which seals the air groove.

With this configuration, the distribution flow paths are formed so that the flow path formation member in which the air groove is formed is closed by the first flexible member. Therefore, tube-shaped flow paths that penetrate the flow path formation member need not be formed, and to form the distribution flow path, only a comparatively simplified process is required.

The liquid ejection apparatus further comprises a pressure detector, which detects the pressure of the air which flows in the air supply member.

With this configuration, since a change in the pressure in the air supply member can be detected, a shortage of air in the air supply member can be readily detected.

In the liquid ejection apparatus, the pressure detector includes: an introduction chamber, which introduces the air supplied from the air supply member; a diaphragm, which constitutes a wall of the introduction chamber, and which is displaced in accordance with the air pressure in the introduction chamber; and a pressure detection portion, which detects the air pressure based on a displacement of the diaphragm.

With this arrangement, the diaphragm constitutes a wall of the introduction chamber to which air is supplied along the distribution flow path. Therefore, the pressure in the distribution flow path can be detected in accordance with the displacement of the diaphragm.

For the liquid ejection apparatus, the liquid flow paths, corresponding in number to the liquid cartridges, are provided. The liquid flow paths respectively include liquid grooves, formed in the flow path formation member, and a second flexible member which seals the liquid grooves.

With this arrangement, the liquid grooves are formed in the flow path formation member in which the air grooves are also formed, and the liquid grooves and the second flexible member constitute the liquid flow paths. Therefore, it is not necessary for the liquid ejection apparatus to draw air tubes, along which the air pump and the liquid cartridges are to communicate, and liquid tubes, along which the liquid cartridges and the liquid ejection head are to communicate. Therefore, the assembly operation can be simplified. Furthermore, since parts of both the air flow paths and the liquid flow paths are formed for the distribution member, in the liquid ejection apparatus, the space occupied by these flow paths can be reduced.

In the liquid ejection apparatus, the second flexible member is integrally formed with the first flexible member.

According to this arrangement, since the first flexible member and the second flexible member are integrally formed, parts of the air flow paths and the liquid flow paths can be formed simply by using the second flexible member (the first flexible member) to seal one side face of the flow path formation member.

According to another aspect of the invention, a liquid ejection apparatus, comprising:

a plurality of liquid cartridges, each of which stores liquid;

a liquid ejection head, which ejects the liquid; and a plurality of flow paths, which communicates the liquid cartridges with the liquid ejection head, wherein the liquid flow paths include:

a plurality of liquid grooves, which are formed in a flow path formation member; and a flexible member; and wherein the flexible member seals openings of the liquid grooves to form the liquid flow paths.

With this configuration, the liquid grooves are formed in the flow path formation member, and both the liquid grooves and the second flexible member constitute the liquid flow paths. Therefore, it is not necessary for the liquid ejection apparatus to draw a plurality of liquid tubes, along which the liquid cartridges are to communicate with the liquid ejection head, and the assembly operation can be simplified. Furthermore, since multiple flow paths are formed for the distribution member, in the liquid ejection apparatus, the space occupied by the flow paths can be reduced.

In the liquid ejection apparatus, the lengths, the cross sectional areas, and the surface roughness levels of walls of the liquid grooves which constitute the liquid flow paths are the same.

With this arrangement, since the lengths, the cross sectional areas and the roughness levels are the same for the liquid flow paths that are constituted by the liquid grooves, differences in pressure losses along the liquid flow paths can be avoided.

In the liquid ejection apparatus, the surface roughness levels of walls of the liquid grooves constituting the liquid flow paths are different in accordance with at least one of the lengths and the cross sectional areas of the liquid grooves.

With this arrangement, based on the lengths or the cross sectional areas of the liquid flow paths that are constituted by the liquid grooves, the roughness of the walls differ so that differences in pressure losses along the individual liquid flow paths can be avoided.

In the liquid ejection apparatus, the cross sectional areas of the liquid grooves constituting the liquid flow paths are different in accordance with at least one of the lengths and the surface roughness levels of the liquid grooves.

According to this arrangement, based on the lengths or the surface roughness of the liquid flow paths that are constituted by the liquid grooves, the cross-sectional areas differ, so that differences in pressure losses along the individual liquid flow paths can be avoided.

In the liquid ejection apparatus, the distribution member is provided above the liquid ejection head in a gravitational direction.

According to this arrangement, since gravitational attraction easily feeds the liquid downward, from the liquid flow paths formed in the distribution member, the liquid from the distribution member can be smoothly supplied to the liquid ejection head.

In the liquid ejection apparatus, the flow path formation member is plate-shaped, and includes a side face. The air outlet portions and a plurality of liquid inlet ports through which liquids from the liquid cartridges are introduced, are provided on the side face of the flow path formation member.

Since the air outlet portions and the liquid inlet portions are provided on the side face of the plate shaped flow path formation member, these portions can correspond to a plurality of liquid cartridges arranged in a row. Further, the distribution member can be compactly constructed.

In the liquid ejection apparatus, the branch flow paths are constituted by flexible tubes.

Since the branch flow paths are constituted by flexible tubes, the liquid cartridges and the distribution member can be connected by bending these tubes. Thus, no limitations are imposed on the relative positions that can be occupied by the liquid cartridges and the distribution member.

In the liquid ejection apparatus, the distribution member is comprised of thermoplastic resin.

According to this arrangement, the distribution member in which the grooves are formed can be produced comparatively easily. Further, compared with when the air flow path and the liquid flow paths are formed entirely of tubes, the evaporation of liquid and the entry of air can be prevented.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A liquid ejection apparatus according to one embodiment of the present invention will now be described while referring to FIGS. 1 to 11.

Figure 1:
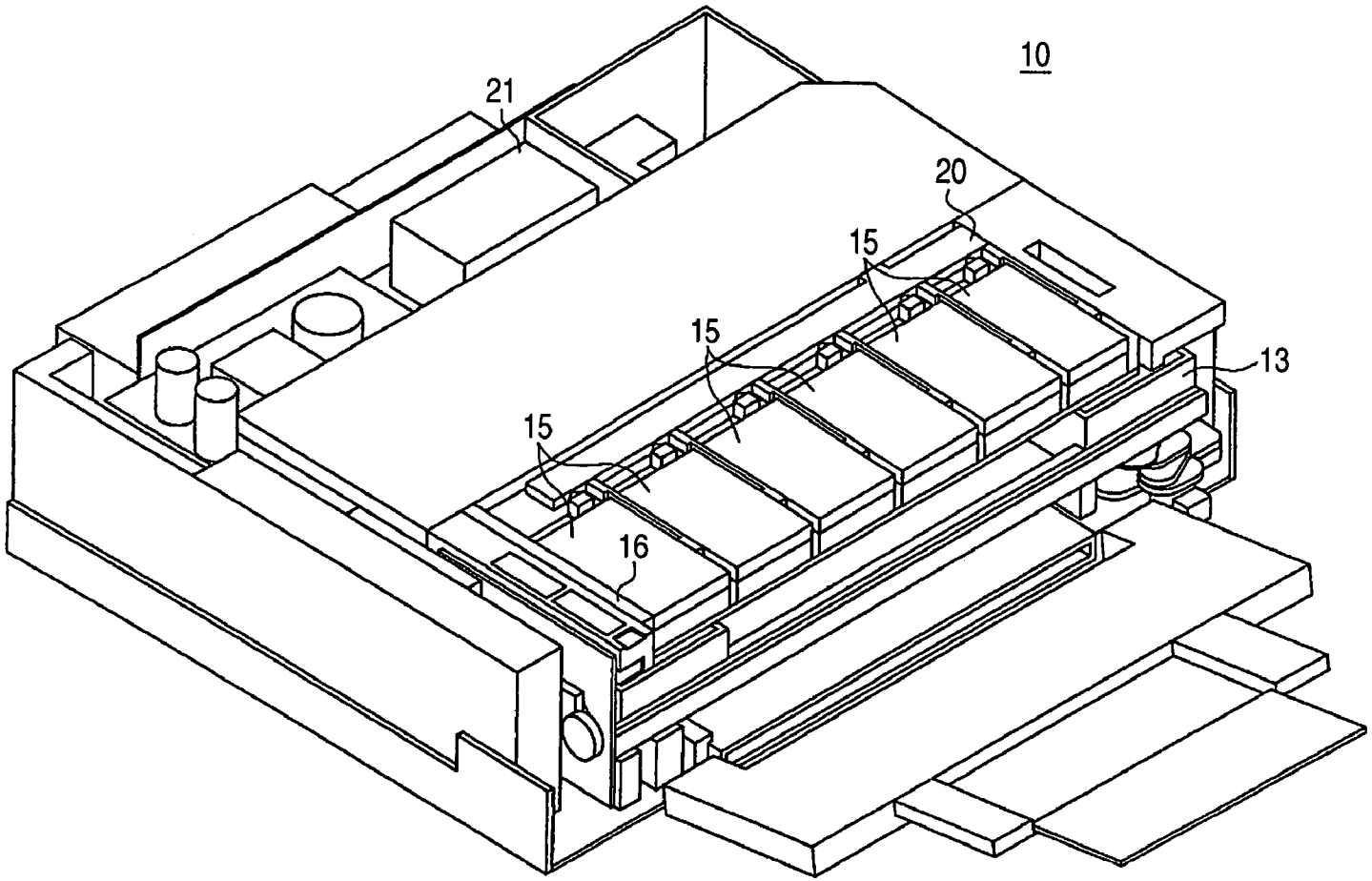
FIG. 1 is a perspective view of a printer main body according to one embodiment of the present invention.

FIG. 1 is a perspective view of a printer main body 10 of an ink-jet recording apparatus (hereinafter referred to as a printer) that serves as a liquid ejection apparatus. While FIG. 2 is a perspective view of an essential portion of the printer main body 10.

Figure 2:
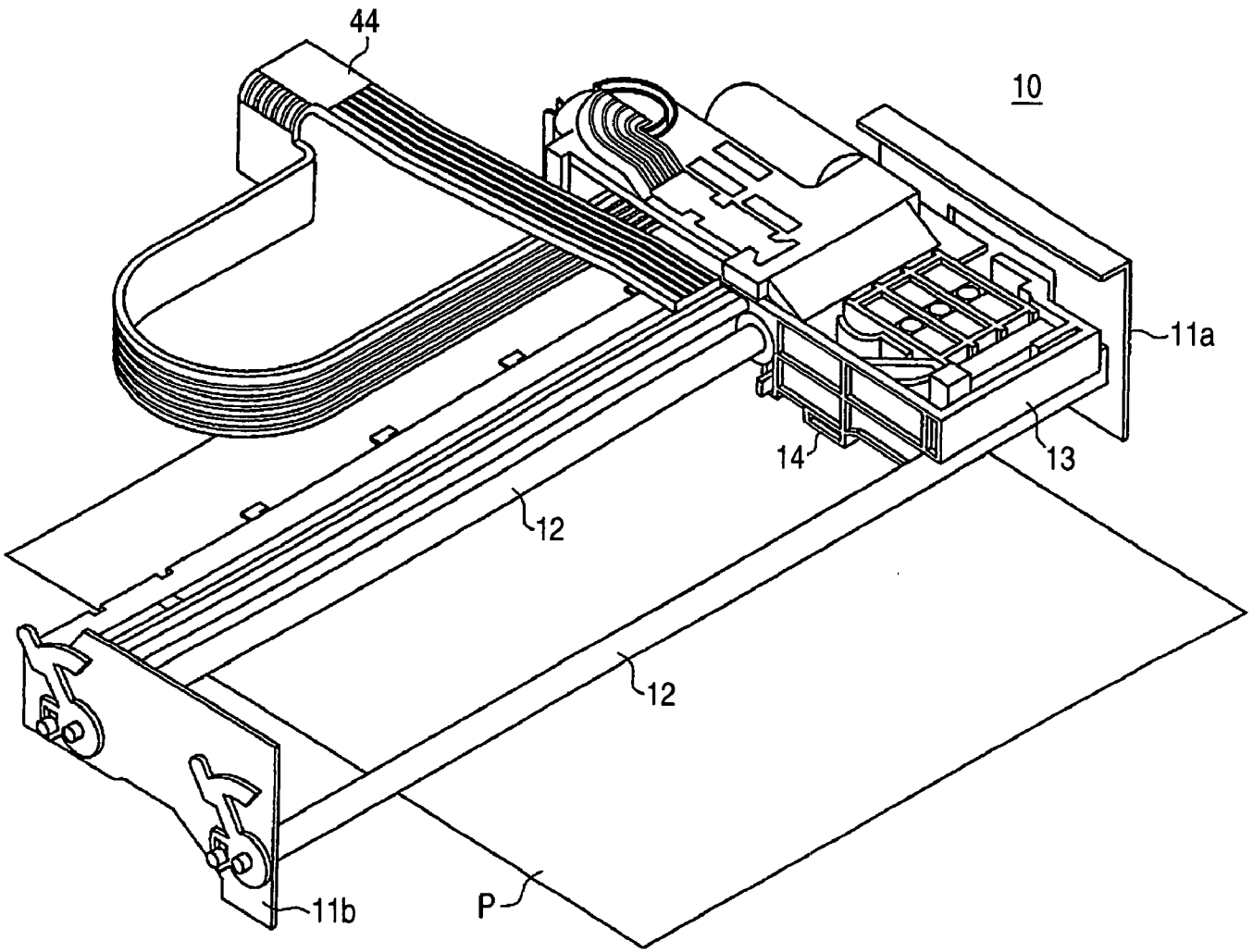
FIG. 2 is a perspective view of the essential portion of the printer main body.

As shown in FIG. 2, frame plates 11*a* and 11*b* are so located on the respective sides of the printer main body 10 that face each other, and a guide member 12 is extended between the frame plates 11*a* and 11*b*. A carriage 13 is slidably supported by the guide member 12 and reciprocates along the guide member 12, driven by a carriage motor (not shown). Below the guide member 12, a paper sheet P is conveyed by a paper feeding mechanism (not shown) in a direction substantially perpendicular to the direction in which the carriage 13 reciprocates.

As a liquid ejection head, a recording head 14 is mounted on the carriage 13 on the side opposite the paper sheet P. On the lower face of the recording head 14, a plurality of nozzle orifices (not shown) are formed, and as piezoelectric devices (not shown) are driven, liquid ink is ejected through these nozzle orifices onto a sheet to perform printing. In this embodiment, nozzle orifices for ejecting six different types of ink are formed on the recording head 14.

Figure 3:
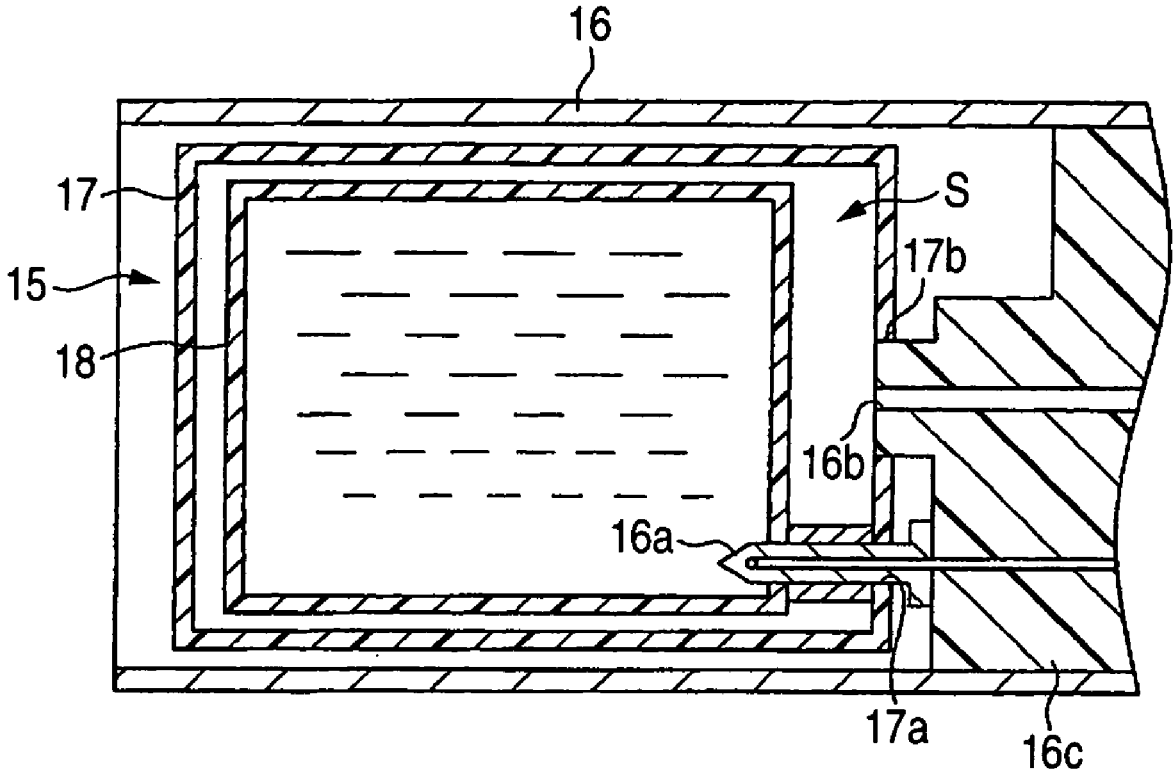
FIG. 3 is a cross-sectional view of an ink cartridge.

Ink to be supplied to the recording head 14 is stored in ink cartridges 15, which serve as liquid cartridges. As shown in FIG. 1, an array of the ink cartridges 15 is arranged on the carriage 13. At this time, the individual ink cartridges 15 are detachably stored in holders 16 provided on the printer main body 10. As shown in FIG. 3, each of the ink cartridges 15 includes a case 17, constituting a pressure chamber, an ink pack 18 that serves as a liquid supply portion and a flexible portion. The ink pack 18 is stored in the case 17, and a gap S is defined by a pressure chamber located between the inner wall of the case 17 and the ink pack 18. The holder 16 and the case 17 are both square shaped and are made of a high rigid synthetic resin, while the ink pack 18, which stores ink, is bag shaped and is composed of a flexible material, such as a polyethylene film on which aluminum is deposited, that possesses a gas barrier property.

Further, a needle insertion hole 17*a* is formed in one side face of the; case 17 for the insertion of a needle 16*a* of the holder 16. When the needle 16*a* is inserted into the needle insertion hole 17*a*, the needle 16*a* is inserted into the ink pack 18 so that ink is supplied to an exterior portion through the needle 16*a*.

Furthermore, an air inlet port 17*b* is formed on the side face of the case 17 in which the needle insertion hole 17*a* is formed. This air inlet port 17*b* is fitted over an air feed port 16*b* that projects outward from one side face of the holder 16. The air feed port 16*b* communicates with a converging flow path 20 shown in FIG. 1 through a corresponding distribution tube 19 that serves as a branch flow path and air feeding member. The converging flow path 20 separately distributes to the ink cartridges 15 pressurized air which is received from an air pump 21 constituting the air feeding member. Therefore, when the air feed port 16*b* is fitted into the air inlet port 17*b*, pressurized air from the air feed port 16*b* flows into and fills the gap S. Under the pressure applied by the air filling the gap S, the ink pack 18 constituting the flexible member is compressed. As a result, ink is expelled from the ink pack 18 and is fed through the needle 16*a* which is inserted therein. The ink output through the needle 16*a* is then supplied to the converging flow path 20 shown in FIG. 1.

Figure 4:
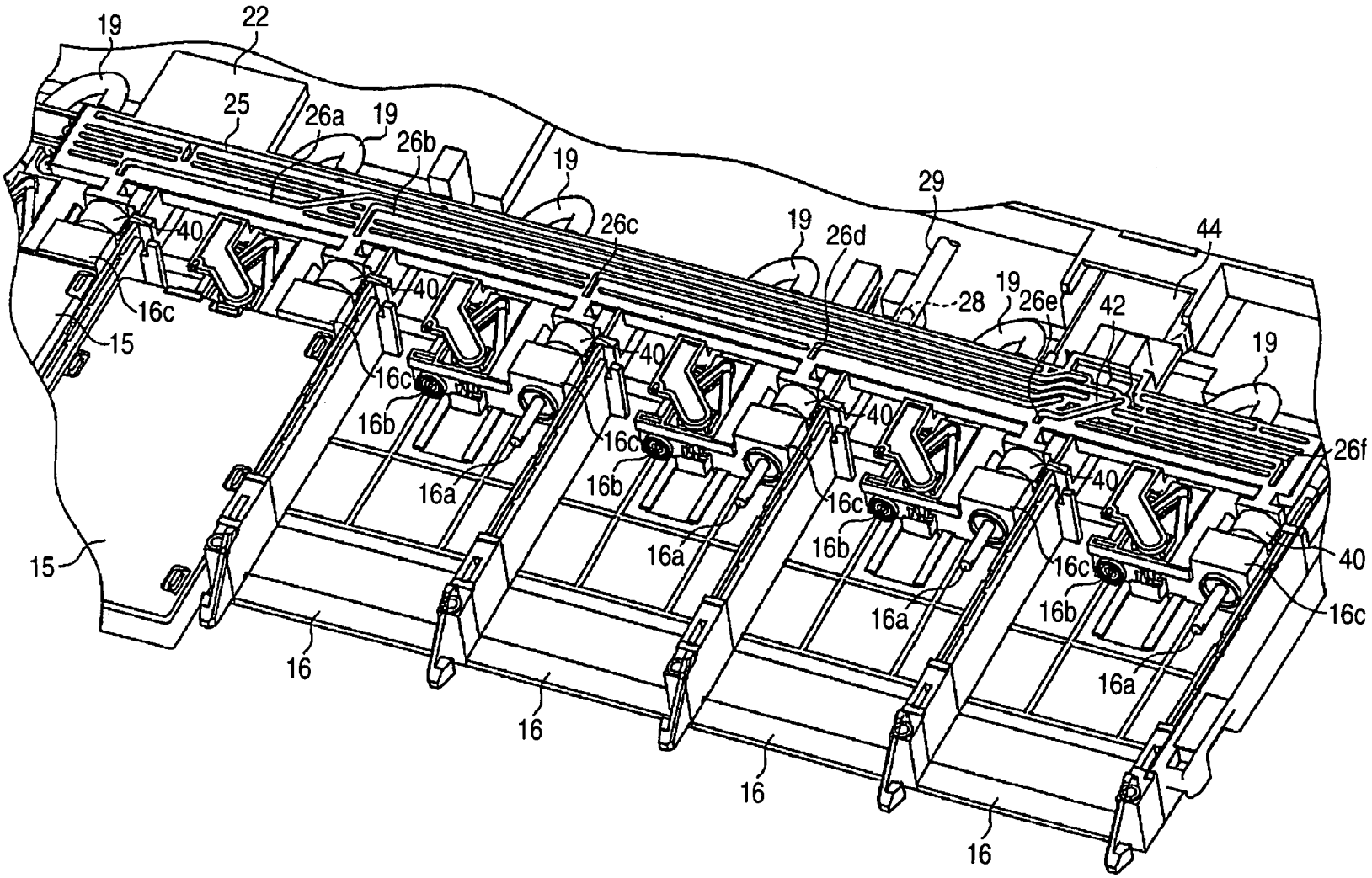
FIG. 4 is a perspective view of a converging flow path provided on the printer main body.
Figure 5:
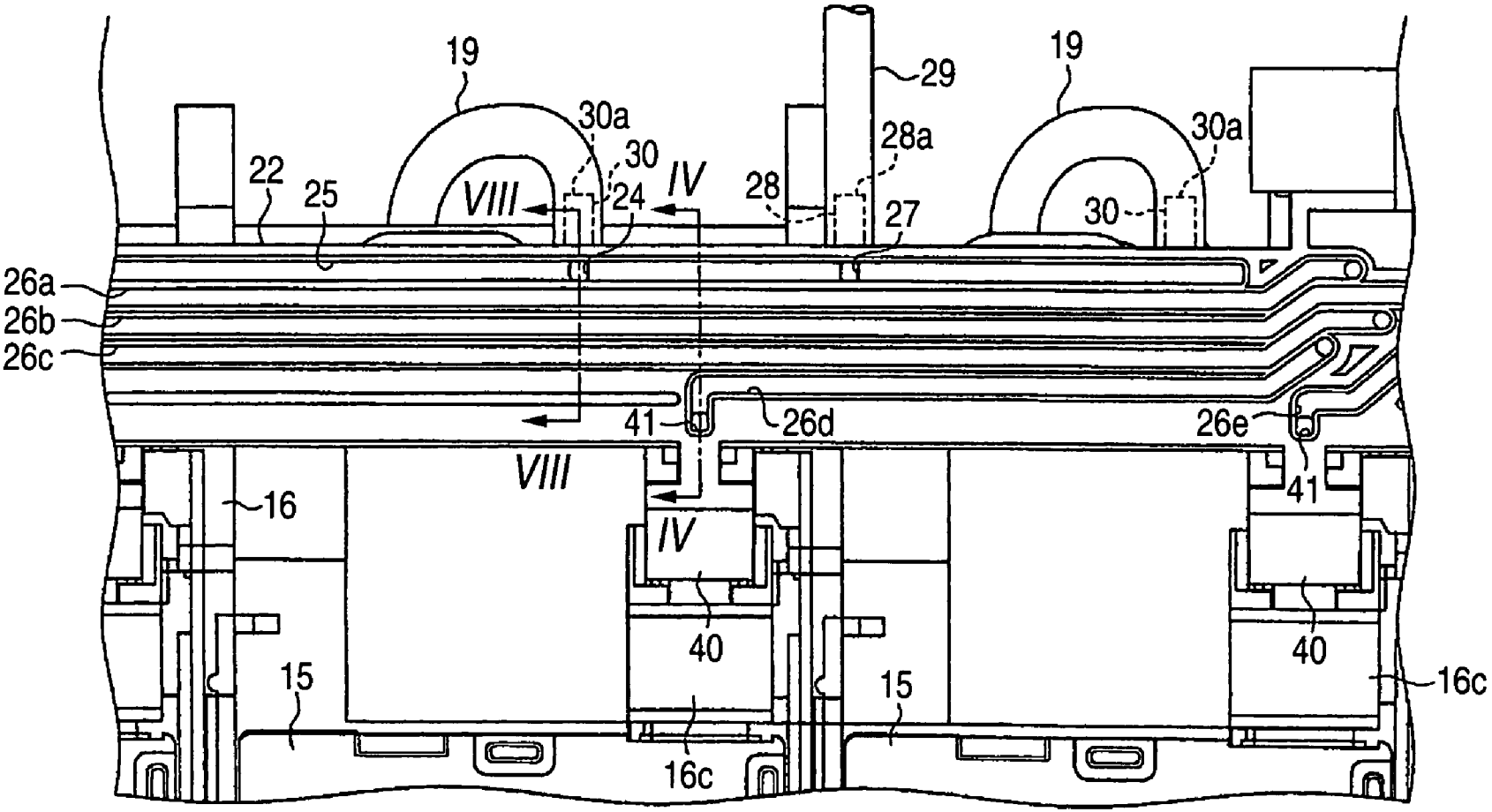
FIG. 5 is a plan view of the converging flow path.
Figure 6:
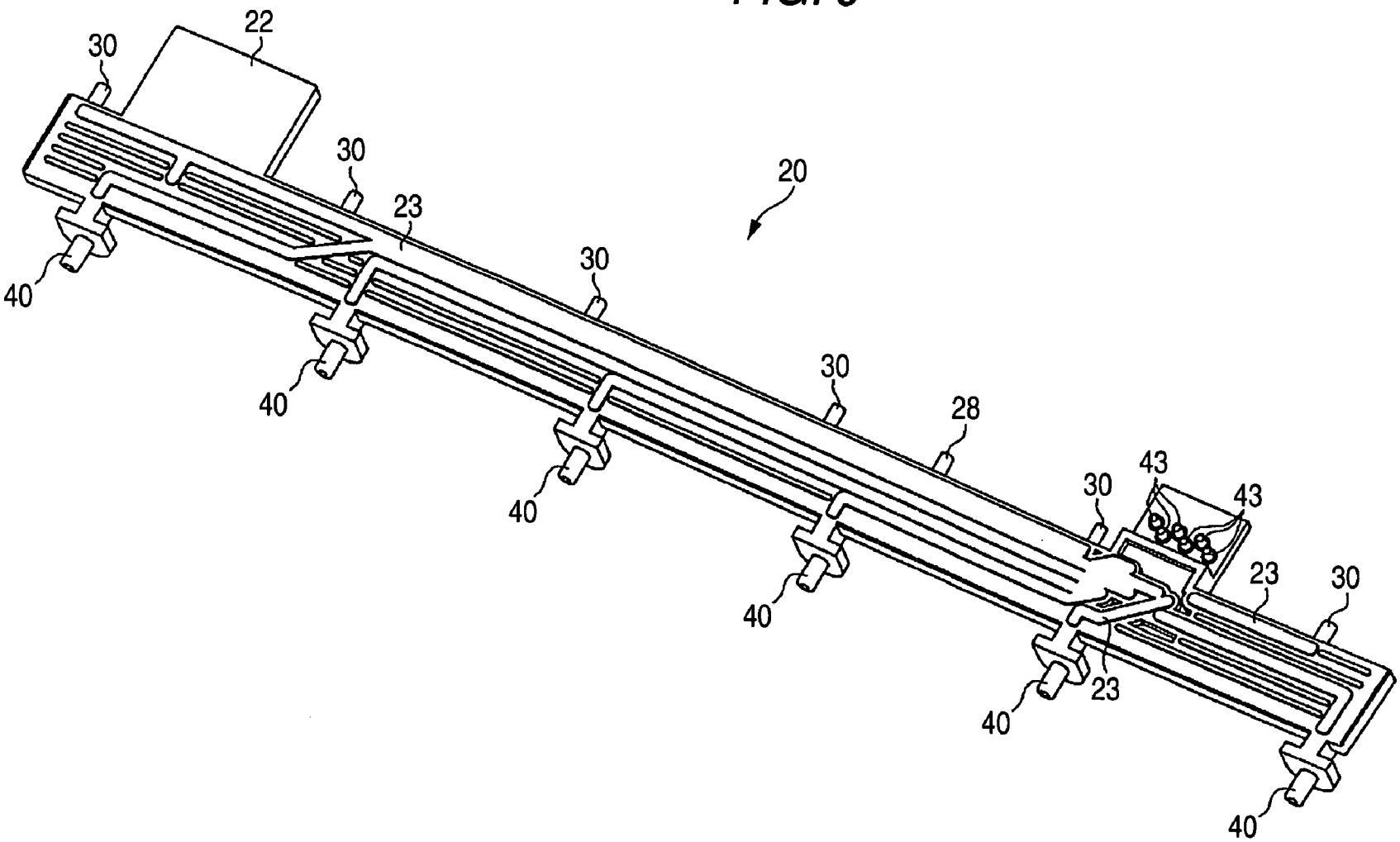
FIG. 6 is a perspective view of the converging flow path.
Figure 7:
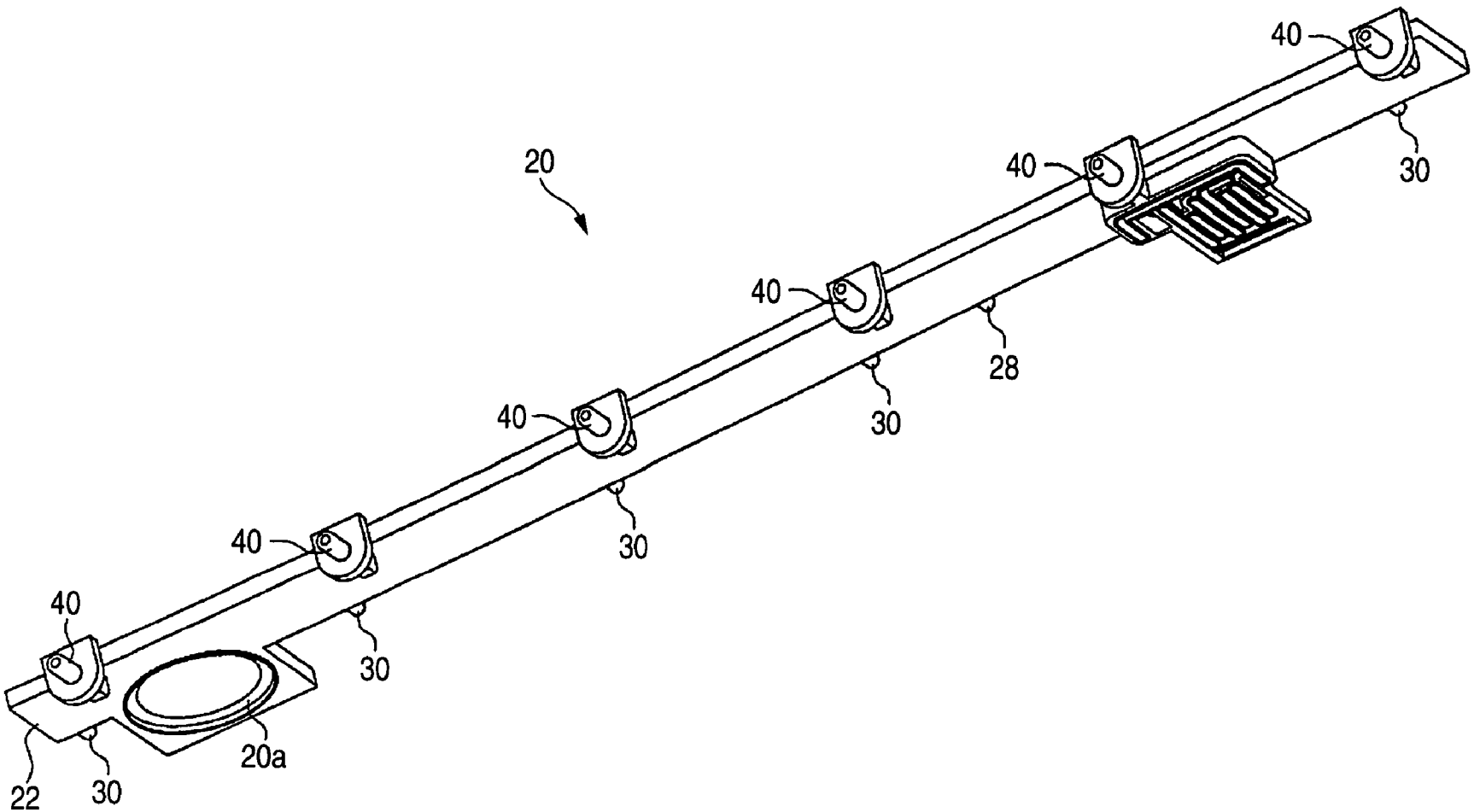
FIG. 7 is a perspective view of the converging flow path.
Figure 8:
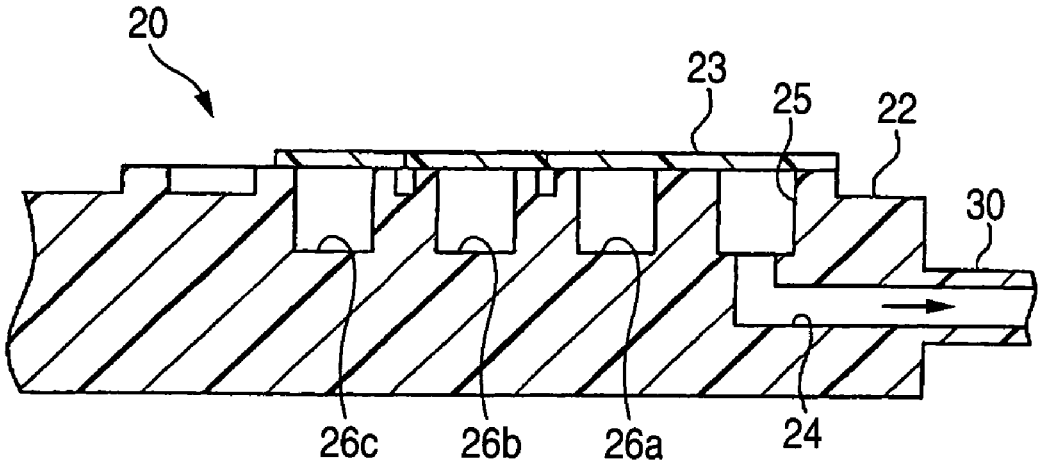
FIG. 8 is a cross-sectional view of the essential portion of the converging flow path.
Figure 9:
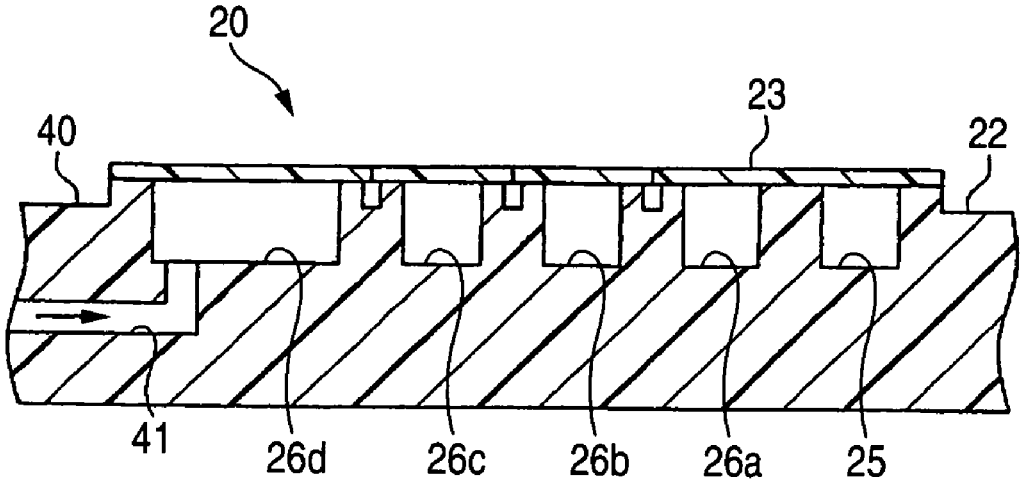
FIG. 9 is a cross-sectional view of the essential portion of the converging flow path.

The converging flow path 20 constituting the air feeding member and the air distribution member will be described in detail while referring to FIGS. 4 to 8. FIG. 4 is a perspective view of the converging flow path 20, which is provided for the printer main body 10, and FIG. 5 is a plan view of a portion of the converging flow path 20. FIGS. 6 and 7 are respectively a top perspective view and a bottom perspective view of the converging flow path 20, and FIGS. 8 and 9 are cross-sectional views respectively taken along line VIII—VIII and line IX—IX in FIG. 5.

As shown in FIGS. 6 to 9, the converging flow path 20 includes a plate shaped, flow path formation member 22 and a film member 23 which is adhered to the upper face of the flow path formation member 22. The flow path formation member 22 is made of a thermoplastic resin. The flow path formation member 22 has an air groove 25, which serves as an air distribution path and an air feeding groove, and six ink grooves 26*a* to 26*f*, which correspond to the ink cartridges 15 and serve as liquid flow paths and liquid grooves. The air groove 25 and the ink grooves 26*a* to 26*f* are extended in the longitudinal direction of the flow path formation member 22, and the shapes and the lengths of the grooves are different each other.

The air groove 25 and the ink grooves 26*a* to 26*f* have open tops, and the film member 23 is adhered to the openings by heat sealing. As shown in FIG. 6, the film member 23 is branched like twigs in consonance with the shapes of the grooves, and is formed of a film portion for closing the air groove 25 and the ink grooves 26*a* to 26*e*, a film portion for closing the ink groove 26*f*, and a film portion for closing the portion of the air groove 25 located at the right end of the film member 23. The film member 23 and the air groove 25 constitute part of an air flow path, while the film member 23 and the ink grooves 26*a* to 26*f* constitute parts of ink flow paths. Therefore, the processing for cutting the flow path formation member 22 and forming the individual flow paths through the flow path formation member 22 is not required when the air flow path and parts of the ink flow paths at the converging flow path 20 are formed, and the individual flow paths can be comparatively easily formed. In addition, compared with when the air flow path and the ink flow paths are formed entirely by using tubes, the evaporation of ink solvent and the entry of air can be prevented.

The film member 23, which forms the distribution flow path, the liquid flow paths, the flexible air member and the flexible liquid member, is a multi-layer film having a gas barrier property, which is provided by the deposition of SiOx or aluminum, for example, on a film made of a synthetic resin such as polyethylene. Since the gas barrier property of the film member 23 is higher than that of a flexible tube, the gas barrier properties of the air flow path and the ink flow paths provided on the converted flow path 20 can be increased. Therefore, air, or a gas volatilized from ink, can be prevented from leaking out of the air flow path and the ink flow paths. It should be noted that for the sake of convenience during the explanation, the film member 23 is not adhered to the flow path formation member 22 in FIGS. 4 and 5.

The air flow path provided on the converging flow path 20 will now be described. As shown in FIG. 5, one end of an intake through hole 27, through which the air groove 25 communicates with the outside, is opened in the bottom of the air groove 25. The intake through hole 27 is formed in the flow path formation member 22, and reaches one end of a pump connection portion 28 that projects from one side of the flow path formation member 22. The opening at the pump connection portion 28 is used as an air intake port 28*a* through which air discharged by an air pump 21 enters.

One end of a pump tube 29 is inserted into the pump connection portion 28 in which the intake through hole 27 is formed, and the air groove 25 and the air pump 21 communicate through the pump tube 29. The other end of the pump tube 29 is connected to the air pump 21, permitting the air intake through hole 27 to communicate with the air pump 21. With this arrangement, pressurized air generated by the air pump 21 is provided along the pump tube 29 to the air flow path, which it fills, that is constituted by the air groove 25 and the film member 23.

As shown in FIGS. 5 and 8, one end of an air hole 24, through which air in the air groove 25 (the air flow path) is externally discharged, opens in the bottom of the air groove 25. In this embodiment, in consonance with the number of ink cartridges 15, six air holes 24 are formed in the flow path formation member 22. Each of the air holes 24 penetrates the flow path formation member 22, and opens at one end of a corresponding first cartridge connection portion 30 projecting from one side of the flow path formation member 22. The openings provided by the air holes 24 are used as air outlet ports 30*a* from which air in the air groove 25 is externally discharged. In consonance with the six air holes 24, six of the first cartridge connection portions 30 are provided on the side face of the flow path formation member 22 wherein the pump connection portion 28 is located.

One end of a distribution tube 19 is inserted into a corresponding first cartridge connection portion 30, so that air discharged through the air hole 24 is introduced into the ink cartridge 15. The other end of the distribution tube 19 is connected to a holder connection portion (not shown) provided on a corresponding holder 16. The individual holder connection portions communicate with the air feed ports 16*b* that are also provided on the holders 16. Since the distances between the first cartridge connection portions 30 and the holder connection portions are all the same, the individual distribution tubes 19 have the same lengths. As a result, the manufacture of the distribution tubes 19 can be simplified.

With this arrangement, the pressurized air that has filled the air flow path formed by the air groove 25 and the film member 23 is distributed by entering the air holes 24, and is supplied along the distribution tubes 19 to the air feed ports 16*b*. From the air feed ports 16*b*, the pressurized air is supplied to the gaps S through the air inlet ports 17*b* in the cases 17, which are stored in the holders 16.

During the assembly operation, first, the pump connection portion 28 of the converging flow path 20, which is attached to the printer main body 10, is connected to the air pump 21 by the pump tube 29. Then, the first cartridge connection portions are connected to the corresponding holder connection portions (not shown) of the holders 16, which are attached to the printer main body 10, by the distribution tubes 19. According to this arrangement, a plurality of tubes need not be drawn inside the apparatus in order to connect the air pump 21 to the ink cartridges 15. Therefore, the assembly operation for connecting the air pump 21 and the ink cartridges 15 can be simplified. Furthermore, in the printer main body 10, extra space is not required for drawing or bending tubes that connect the air pump 21 to the ink cartridges, and thus, the space required by the air flow path or the printer main body 10 can be reduced.

As shown in FIG. 7, a detector holder 20*a*, in which a pressure detector 31 is stored, is recessed in the lower face of the flow path formation member 22. The pressure detector 31 detects a reduction in the air pressure in the air flow path constituted by the air groove 25 and the film member 23, and transmits an air supply instruction to the air pump 21.

Figure 10:
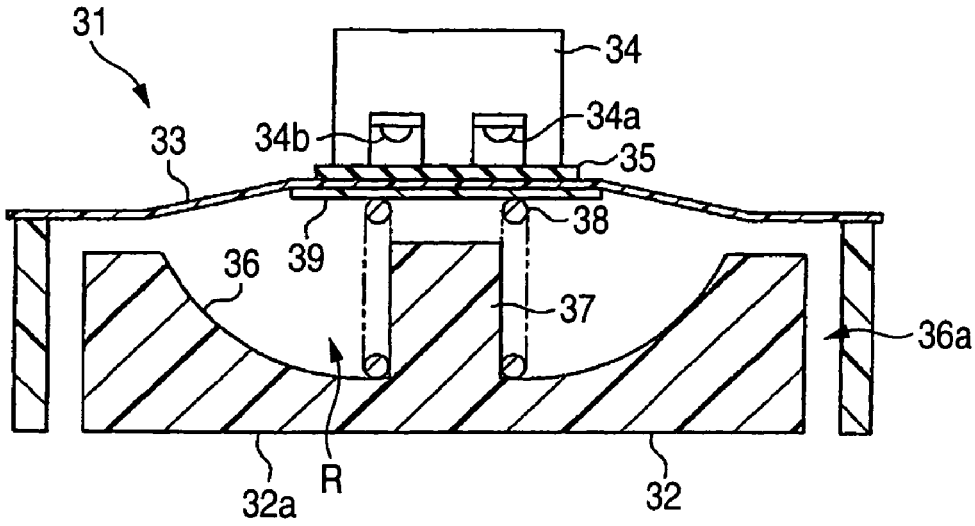
FIG. 10 is a cross-sectional view of a pressure detector attached to the converging flow path.
Figure 11:
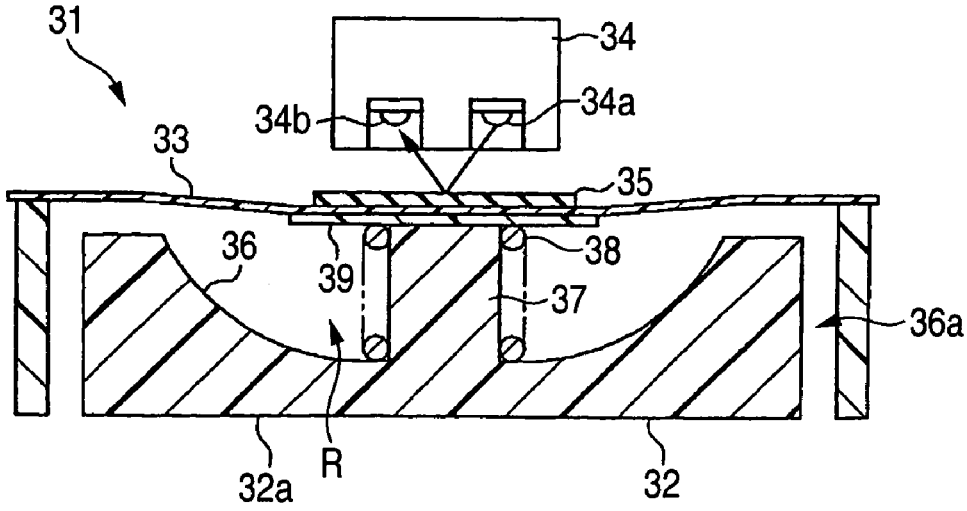
FIG. 11 is a cross-sectional view of the pressure detector.

As shown in FIGS. 10 and 11, the pressure detector 31, serving as a pressure detector, includes a main body 32 made of a thermoplastic resin, a diaphragm 33 made of a flexible material which is adhered to the opening of the main body 32, and an optical sensor unit 34. The main body 32 is integrally formed with the flow path formation member 22, so that a side face 32*a*, which is opposed to a side face to which the diaphragm 33 is adhered, is directed toward the bottom face of the detector holder 20*a*. Since the main body 32 is integrally formed with the flow path formation member 22, the space required can be reduced, compared with when a pressure detector is provided outside the flow path formation member 22.

A communication path 36*a*, having in cross section a substantially U shape, is formed inside the main body 32. The communication path 36*a* is connected to the air groove 25 of the flow formation member 22 via a through hole (not shown) that is formed in the bottom face of the detector holder 20*a*, and serves as part of the air flow path. Further, the communication path 36*a* is open on the diaphragm 33 side, and the flow path is completed by the adhesion of the diaphragm to the communication path 36*a*. In this embodiment, the diaphragm 33 is formed of a film having a gas barrier property.

In addition, a recessed portion 36 is formed in one part of the side face to which the diaphragm 33 is adhered, and the recessed portion 36 and the diaphragm 33 together constitute an introduction chamber R. Since the introduction chamber R is located an route along the communication path 36*a*, the introduction chamber R communicates with the air groove 25. As well as the communication path 36*a*, the introduction chamber R constitutes a part of the air flow path provided on the converging flow path 20. A rod-shaped guide member 37 is formed substantially in the center of the recessed portion 36, and a coil spring 38 is arranged around the guide member 37.

The diaphragm 33 adhered to the main body 32 also includes a resin plate 39 on the introduction chamber R side. The coil spring 38 is located between the resin plate 39 and the bottom of the recessed portion 36, and urges the diaphragm 33 upward. A reflection plate 35, the surface of which is white, is adhered to the external wall (the side opposite the resin plate 39 side) of the diaphragm 33, and a material, such as rubber, having excellent adhesion power is formed on the upper face (the face opposite the optical sensor unit 34) of the reflection plate 35.

The optical sensor unit 34 constituting a pressure detector is located opposite the reflection plate 35, and includes a light-emitting device 34*a* and a light-receiving device 34*b*. Light emitted by the light-emitting device 34*a* is reflected by the reflection plate 35, and the reflected light is received by the light-receiving device 34*b*.

The operation of the pressure detector 31 will now be explained. When the air flow path of the converging flow path 20 is filled with pressurized air, the introduction chamber R and the communication path 36*a* are also filled with pressurized air. Therefore, the diaphragm 33 is pushed upward by the air pressure in the introduction chamber R and the urging force of the coil spring 38, and the reflection plate 35 adhered to the external wall of the diaphragm 33 is brought into contact with the optical sensor unit 34. As a result, the light-emitting device 34*a* and the light-receiving device 34*b* are closed, and the optical sensor unit 34 is set to an OFF state wherein an electric signal can not be transmitted by the light-receiving device 34*b*.

Further, when all the ink in the ink pack 18 has been consumed and the volume of the gap S defined between the case 17 and the ink pack 18 is increased, the pressure in the gap S is reduced, as is the pressure in the air flow path of the converging flow path 20. Therefore, the pressure in the introduction chamber R and along the communication path 36*a* is also reduced, and the diaphragm 33 is displaced toward the introduction chamber R against the urging force exerted by the coil spring 38. With this displacement, the diaphragm 33 is separated from the optical sensor unit 34, and as a result, light emitted by the light-emitting device 34*a* is reflected by the reflection plate 35 and is detected by the light-receiving device 34*b*. In response to an electric signal generated by the detection of the reflected light, a controller (not shown) for the printer main body 10 transmits a start instruction to the driver of the air pump 21. Upon the reception of this instruction by the driver, the air pump 21 is started and transmits pressurized air to the air flow path of the converging flow path 20. As a result, when a reduction in air pressure in the air flow path is detected, pressurized air can be supplied to the air flow path.

The ink flow paths, which serve as liquid flow paths, will now be described. As shown in FIG. 4, the six ink grooves 26*a* to 26*f*, which are formed in the flow path formation member 22, are extended in the longitudinal direction of the flow path formation member 22, and are bent as L shape at locations corresponding to the ink cartridges 15 toward the ink cartridges 15. As shown in FIGS. 8 and 9, by the adhesion of the film member 23 to the ink grooves 26*a* to 26*f*, the ink grooves 26*a* to 26*f*, as well as the air groove 25, become integral parts of the ink flow paths. Since not only the air flow path, but also the ink flow paths are provided on the converging flow path 20, the space required can be reduced, compared with when tubes for connecting the ink cartridges 15 to the recording head 14 are drawn and arranged within the apparatus.

As shown in FIG. 9, one end of an ink through hole is opened in the bottom of each of the ink grooves 26*a* to 26*f* for the introduction of ink into the corresponding ink groove (ink flow path). The ink through holes 41 that constitute the liquid flow paths and the liquid inlet port are formed inside the flow path formation member 22.

Further, each of the other ends of the ink holes 41 opens at the end of a corresponding second cartridge connection portion 40 projecting from the side face of the flow path formation member 22. As shown in FIG. 6, along the side of the flow path formation member 22 opposite that whereat the first cartridge connection portions 30 and the pump connection portion 28 are formed, six of the second cartridge connection portions 40 are provided at locations corresponding to the ink cartridges 15. As shown in FIG. 4, the second cartridge connection portions 40 are fitted into needle supporting portions 16*c*, attached to the holders 16, and are connected to the needles 16*a*.

With this configuration, ink is fed from the ink packs 18 through the needles 16*a*, and is supplied to the ink grooves (ink flow paths) 26*a* to 26*f* along the ink holes 41 formed in the flow path formation member 22. The ink flow paths constituted by the ink grooves 26*a* to 26*f* converge at a converging portion 42 that is located at one part of the flow path formation member 22, and ink is output at ink supply ports 43. An ink guide member 44 shown in FIG. 4 is connected to the ink supply ports 43, and ink discharged through the ink supply ports 43 is fed through the ink guide member 44 to the recording head 14. The ink guide member 44 is flexible, and includes a plurality of flow paths along which ink from the ink supply ports 43 is supplied to the recording head 14.

To connect the ink cartridges 15 to the recording head 14, the second cartridge connection portions 40 of the converging flow path 20 are inserted into the needle support portions 16*c* of the holders 16, and at one end, the ink guide member 44 is connected to the ink supply ports 43. According to this arrangement, a plurality of tubes need not be drawn and arranged in the apparatus in order to connect the ink cartridges 15 to the recording head 14, and the assembly operation can be simplified. Further, since extra space in the apparatus is not required for the drawing of tubes to connect the ink cartridges 15 to the recording head 14, the space required for the ink flow paths or the printer main body 10 can be reduced.

The distances from the ink packs 18, through the ink holes 41 and the ink grooves 26*a* to 26*f*, to the corresponding ink supply paths 43, i.e., the lengths of the ink flow paths, is different to each other. Therefore, due to these differences in the lengths of the ink flow paths, differences also occur in the pressure losses generated along the individual ink flow paths. To prevent the occurrence of differences in the pressure losses, in this embodiment, based on the differences in the lengths, the cross-sectional areas of the ink grooves 26*a* to 26*f* differ. That is, since the factors for determining pressure loss are the cross-sectional area, the length and the roughness of a flow path, as the length of a flow path is extended, the pressure loss is increased, while as the cross-sectional area of a flow path is expanded, the pressure loss is reduced. Therefore, based on-the lengths of the ink flow paths, the cross-sectional area of one of the ink grooves 26*a* to 26*f* along which the distance between the ink pack 18 to the ink supply port 443 is comparatively extended is increased, while the cross-sectional area of an ink groove 26*a* to 26*f* for which the distance is comparatively shortened is reduced. As a result, ink pressure differences at the ink supply ports 43 can be avoided.

According to the embodiment, the following effects can be obtained.

(1) In this embodiment, via the air intake port 28*a* provided on the converging flow path 20, air compressed by the air pump 21 is supplied to the air flow path formed by the air groove 25 and the film member 23. Further, pressurized air flowing into the air flow path is distributed separately to the six air holes 24 that open at the bottom of the air groove 25. Then, this pressurized air is supplied through the distribution tubes 19 to the gaps S defined between the ink packs 18 and the cases 17.

With this configuration, a plurality of tubes need not be drawn and arranged in the apparatus in order to connect the air pump 21 to the ink cartridges 15, and the assembly operation can be simplified.

In addition, extra space is not required in the printer main body 10 for the drawing or bending of tubes that connect the air pump 21 and the ink cartridges 15. Therefore, the space required for the air flow path and the printer main body 10 can be reduced.

(2) In the embodiment of this invention, the same length is provided on the distribution tubes 19 that permits the converging flow path 20 to communicate with the gaps S provided on the ink cartridges 15. Therefore, the manufacture of tubes having different lengths can be avoided, and the distribution tubes 19 can be easily produced.

(3) In the embodiment, part of the air flow path is constituted by the air groove 25 formed in the flow path formation member 22 and the film member 23 adhered to the flow path formation member 22. Therefore, compared with when a tube-shaped flow path is formed by cutting and penetrating the flow path formation member 22, the air flow path can be provided more easily. Furthermore, compared with when the air flow path and the ink flow paths are entirely constituted by using tubes, the evaporation of ink solvent and the entry of air can be prevented.

(4) In this embodiment, the pressure detector 31 is provided on the converging flow path 20 to detect the pressure along the air flow path that is formed in the converging flow path 20. The pressure detector 31 includes: the introduction chamber R, which is used to introduce air discharged by the air pump 21; the diaphragm 33, which constitutes the wall of the introduction chamber R and is displaced in consonance with the pressure in the introduction chamber R; and the optical sensor unit 34, which detects the displacement of the diaphragm 33. The introduction chamber R is integrally formed with the flow path formation member 22, and with the air groove 25, with which it communicates, constitutes part of the air flow path that is provided on the converging flow path 20. With this configuration, a shortage of air along the air flow path can be detected, and when an air is detected, air supplied to the air flow path can be supplemented.

(5) In the embodiment, the six ink grooves 26*a* to 26*f* are formed in the flow path formation member 22 in which the air groove 25 is also formed, and the ink grooves 26*a* to 26*f* and the film member 23 constitute parts of the ink flow paths.

Since the air flow path and parts of the ink flow paths are formed in the converging flow path 20, the space requirement can be reduced, compared with when tubes are drawn and arranged in the apparatus to connect the ink cartridges 15 to the recording head 14. Furthermore, since tubes need not be drawn and located in the printer main body 10 to provide communication between the ink cartridges 15 and the recording head 14, the assembly operation can be simplified.

The embodiment of the invention may be modified as follows.

In the embodiment, the cross-sectional areas of the ink flow paths differ based on the lengths of the ink flow paths. However, uniform lengths, cross-sectional areas and roughness wall levels may be provided on of the ink grooves 26*a* to 26*f*. Alternatively, the roughness levels of the walls of the ink grooves 26*a* to 26*f* may differ based on the lengths thereof.

In the embodiment, the form of the film member 23 is branched like twigs in consonance with the shapes of the individual grooves. However, a film member 23 having a square shape may be formed, and the air groove 25 and the ink grooves 26*a* to 26*f* formed in the flow path formation member 22 may be covered with this film member 23. With this arrangement, the labor required to adhere the film member 23 can be reduced.

In the embodiment, the ink cartridges 15 that serve as liquid cartridges are constituted by the ink packs 18, which serve as liquid containers, and the cases 17, which serve as pressure chambers. However, different types of liquid containers and pressure chambers may be employed to constitute the liquid cartridges. As an example liquid container, the inside of a case may be partitioned by using flexible films to define the liquid containers and the pressure chambers.

In the embodiment, the ink jet recording apparatus (printer main body 10) for ejecting ink has been explained as being a liquid ejection apparatus. However, another liquid ejection apparatus can also be employed, e.g., a printing apparatus such as a facsimile machine or a copier, a liquid ejection apparatus that ejects a liquid, such as an electrode material or a coloring material, and that is used in the manufacture of liquid crystal displays, EL displays and plane light-emitting displays, a liquid ejection apparatus that ejects a bio-organic material used for bio-chip manufacturing, or a sample ejection apparatus that is used as a precision pipet. The present invention can also be applied as a valve device that is used for apparatuses other than liquid ejection apparatuses. Furthermore, the liquid used is not limited to ink; another liquid may also be employed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejection apparatus, comprising:

a plurality of liquid cartridges, each of which includes a liquid container and a pressure chamber, the liquid container having a flexible portion and storing liquid therein, and the pressure chamber applying pressure to the flexible portion of the liquid container;

a liquid ejection head, which ejects the liquid;

a plurality of liquid flow paths, which communicate the liquid containers with the liquid ejection head; and an air supply member, which supplies pressurized air to the pressure chambers for compressing the flexible portions so as to supply the liquid from the liquid containers to the liquid flow paths, wherein the air supply member includes:

a distribution member, which has an air intake portion for introducing the pressurized air, and a plurality of air outlet portions for distributing the pressurized air to the liquid cartridges; and a plurality of branch flow paths, which respectively communicate the air outlet portions with the pressure chambers of the liquid cartridges, wherein the distribution member includes a distribution flow path which communicates the air intake portion with the air outlet portions; and wherein the distribution flow path includes an air groove, formed in a flow path formation member, and a first flexible member which seals the air groove.

2. The liquid ejection apparatus as set forth in claim 1, wherein the lengths of the branch flow paths are uniform.

3. The liquid ejection apparatus as set forth in claim 1, further comprising a pressure detector, which detects the pressure of the air which flows in the air supply member.

4. The liquid ejection apparatus as set forth in claim 3, wherein the pressure detector includes:

an introduction chamber, which introduces the air supplied from the air supply member;

a diaphragm, which constitutes a wall of the introduction chamber, and which is displaced in accordance with the air pressure in the introduction chamber; and a pressure detection portion, which detects the air pressure based on a displacement of the diaphragm.

5. The liquid ejection apparatus as set forth in claim 1, wherein the liquid flow paths, corresponding in number to the liquid cartridges, are provided; and wherein the liquid flow paths respectively include liquid grooves, formed in the flow path formation member, and a second flexible member which seals the liquid grooves.

6. The liquid ejection apparatus as set forth in claim 5, wherein the second flexible member is integrally formed with the first flexible member.

7. The liquid ejection apparatus as set forth in claim 1, wherein the distribution member is provided above the liquid ejection head in a gravitational direction.

8. The liquid ejection apparatus as set forth in claim 1, wherein the flow path formation member is plate-shaped, and includes a side face;

wherein the air outlet portions and a plurality of liquid inlet ports through which liquids from the liquid cartridges are introduced, are provided on the side face of the flow path formation member.

9. The liquid ejection apparatus as set forth in claim 1, wherein the branch flow paths are constituted by flexible tubes.

10. The liquid ejection apparatus as set forth in claim 1, wherein the distribution member is comprised of thermoplastic resin.

11. A liquid ejection apparatus, comprising:

a plurality of liquid cartridges, each of which stores liquid;

a liquid ejection head, which ejects the liquid; and a plurality of liquid flow paths, which communicates the liquid cartridges with the liquid ejection head, wherein the liquid flow paths include:

a plurality of liquid grooves, which are formed in a flow path formation member; and a flexible member; and wherein the flexible member seals openings of the liquid grooves to form the liquid flow paths, wherein the plurality of liquid grooves are arranged in a longitudinal direction of the flow path formation member.

12. The liquid ejection apparatus as set forth in claim 11, wherein the lengths, the cross sectional areas, and the surface roughness levels of walls of the liquid grooves which constitute the liquid flow paths are the same.

13. A liquid ejection apparatus, comprising:

a plurality of liquid cartridges, each of which stores liquid;

a liquid ejection head, which ejects the liquid; and a plurality of liquid flow paths, which communicates the liquid cartridges with the liquid ejection head, wherein the liquid flow paths include:

a plurality of liquid grooves, which are formed in a flow path formation member; and a flexible member; and wherein the flexible member seals openings of the liquid grooves to form the liquid flow paths, wherein the surface roughness levels of walls of the liquid grooves constituting the liquid flow paths are different in accordance with at least one of the lengths and the cross sectional areas of the liquid grooves.

14. A liquid ejection apparatus, comprising:

a plurality of liquid cartridges, each of which stores liquid;

a liquid ejection head, which ejects the liquid; and a plurality of liquid flow paths, which communicates the liquid cartridges with the liquid ejection head, wherein the liquid flow paths include:

a plurality of liquid grooves, which are formed in a flow path formation member; and a flexible member; and wherein the flexible member seals openings of the liquid grooves to form the liquid flow paths, wherein the cross sectional areas of the liquid grooves constituting the liquid flow paths are different in accordance with at least one of the lengths and the surface roughness levels of the liquid grooves.

* * * * *